US005924320A

United States Patent [19]

Michisaka et al.

[11] Patent Number: 5,924,320

[45] Date of Patent: Jul. 20, 1999

[54] DEVICE FOR UNFOLDING A SHAPED METAL ARTICLE AND A METHOD FOR UNFOLDING THE SAME

[75] Inventors: Hirozo Michisaka, Osaka; Saburo Washo, Wakayama; Yasuo Iisaka, Osaka; Kenzo Shitashimizu, Nara, all of Japan

[73] Assignee: Showa Aluminum Corporation, Osaka, Japan

[21] Appl. No.: 08/883,088

[22] Filed: Jun. 26, 1997

[30] Foreign Application Priority Data

Jun. 27, 1996 [JP] Japan ..... 8-167640

[51] Int. Cl.[6] ..... B21D 5/00

[52] U.S. Cl. ..... 72/301; 72/295; 72/305; 72/379.2

[58] Field of Search ..... 72/298, 301, 295, 72/293, 305, 379.2, 422

[56] References Cited

U.S. PATENT DOCUMENTS

| | | | |
|---|---|---|---|
| 2,716,805 | 9/1955 | Reed | 72/256 |
| 2,802,509 | 8/1957 | Anderson et al. | 153/54 |
| 3,712,106 | 1/1973 | Holsapple | 72/309 |
| 4,091,938 | 5/1978 | Trolle | 72/361 |
| 4,187,711 | 2/1980 | Lavochkin | 72/256 |

FOREIGN PATENT DOCUMENTS

| | | | |
|---|---|---|---|
| 106625 | 8/1980 | Japan | 72/256 |

*Primary Examiner*—Daniel C. Crane

[57] ABSTRACT

In a device and method for unfolding a shaped metal article having a longitudinal bent or curved portion, the shaped metal article is unfolded along the bent or curved portion. The device is provided with a vacuum-type absorbing means for absorbing at least one side of the shaped metal article adjacent to the bent or curved portion. The one side of the shaped metal article is unfolded against the other side of the shaped metal article about the bent or curved portion.

15 Claims, 13 Drawing Sheets

DEVICE FOR UNFOLDING A SHAPED METAL ARTICLE AND A METHOD FOR UNFOLDING THE SAME

BACKGROUND OF INVENTION

1. Field of the Invention

The present invention relates to a device for unfolding a shaped metal article and the method for unfolding the same and, more particularly, to a device for unfolding a shaped metal article having a longitudinal bent or curved portion such that the shaped metal article is unfolded along the bent or curved portion and a method for unfolding the same.

2. Related Art

Aluminum extruded articles have been widely used as various kinds of structural materials because of advantages such as lightness, high productivity and low cost. As a result, it has recently been required that extruded articles having a wide width have been also formed as aluminum extruded articles.

Such an aluminum extruded article is obtained by extruding a billet through a forming slit formed in a die member. To obtain a wide extruded article, a die member, a container and a billet must be large, in accordance with the width of the extruded article. Thus, there will be a certain limitation in enlarging them. It is, therefore, impossible to extrude a wide article having more than a certain width.

To cope with the above-mentioned problems, a method for obtaining a wide structural material has been proposed. The method includes the steps of extruding an aluminum article having a longitudinal bent or curved portion. In the method, the opening angle of the bent or curved portion is gradually enlarged by using a rolling mill.

In the unfolding method mentioned above, however, a roll must be replaced with another roll having a larger opening angle after each unfolding step. Thus, it takes a lot of labor to change rolls. Furthermore, one passing of a roll often may not be enough to unfold the article to a certain opening angle, thus several passings of rolls may be required. Therefore, even in each unfolding step, it takes a lot of time to unfold it. Under the circumstances, the unfolding steps of this method are not performed at a high efficiency.

OBJECTS OF THE INVENTION

An object of the present invention which was made to resolve the aforementioned problems is, therefore, to provide a device and a method for unfolding a shaped metal article having a longitudinal bent or curved portion such that the shaped metal article is unfolded along the bent or curved portion at a high efficiency.

Another object of the present invention is to provide a new device and method as an alternative to a conventional rolling mill and rolling method.

Other objects and advantages of the present invention will become apparent from the description contained herein. It should be recognized that the examples are to describe preferred embodiments of the present invention. Accordingly, the invention is not limited to the examples and various modifications are possible within the spirit and the scope of the invention claimed.

SUMMARY OF THE INVENTION

According to one aspect of the present invention, a device for unfolding a shaped metal article having a longitudinal bent or curved portion (hereinafter referred to as a bent portion) such that the shaped metal article is unfolded along the bent portion, includes a vacuum-type absorbing means for absorbing at least one side portion of the shaped article located at one side of the bent portion and a driving means for moving the absorbing means such that the one side portion absorbed by the absorbing means is moved to be unfolded along the bent portion against the other portion located at the other side of the bent portion.

Further, according to another aspect of the present invention, a method for unfolding a shaped article having a longitudinal bent portion such that the shaped article is unfolded along the bent portion includes the steps of absorbing at least one side portion located at one side of the bent portion by a vacuum-type absorbing means and moving the absorbing means such that the one side portion absorbed by the absorbing means is unfolded along the bent portion against the other portion located at the other side of the bent portion.

In the mentioned device and method, since both side portions located at both sides of the bent portion of the shaped metal article is unfolded along the bent portion by moving the vacuum-type absorbing means which absorbs at least one side portion of the shaped article, the shaped article can be unfolded into a desired unfolded shape at high efficiency.

Other objects and advantages of the present invention will become apparent from the description of the preferred embodiments, which may be modified in any manner without departing from the scope and spirit of the invention.

BRIEF DESCRIPTION OF THE DRAWINGS

FIGS. 2A and 2B show the device for unfolding a shaped article, wherein FIG. 2A is an end view showing absorbing means of the device in the final stage of the unfolding steps, and wherein FIG. 2B is an end view showing absorbing means of the device in the first stage of the unfolding steps.

FIGS. 5A to 5C show a second embodiment of the present invention, wherein FIG. 5A is an end view showing a shaped article in which filler materials are fitted, wherein FIG. 5B is an end view showing the shaped article and vacuum-type absorbing means fitted to the shaped article, and wherein FIG. 5C is an end view showing the shaped article and vacuum-type absorbing means in the final stage of the unfolding steps.

FIGS. 8A to 8C show a revised second embodiment, wherein FIG. 8A shows a perspective view of a shaped article and filler material in an disassembled state, wherein FIG. 8B shows a perspective view of the shaped article and the filler material fitted therein, and wherein FIG. 8C shows a longitudinal cross-sectional view of the shaped article and the filler material fitted therein.

FIGS. 10A and 10B show a third embodiment of the invention, wherein FIG. 10A is an end view showing the shaped article and vacuum-type absorbing means disposed along the shaped article, and wherein FIG. 10B is an end view showing the shaped article and vacuum-type absorbing means in the final stage of the unfolding steps.

FIG. 13A and FIG. 13B show a revised third embodiment of the present invention, wherein FIG. 13A is an end view showing the shaped article and vacuum-type absorbing means disposed along the shaped article, and wherein FIG. 13B is an end view showing the shaped article and vacuum-type absorbing means in the final stage of the unfolding steps.

DETAILED DESCRIPTION OF THE PREFERRED EMBODIMENTS

Preferred embodiments according to the present invention will now be described in detail, with reference to the accompanying drawings.

(First Embodiment)

Figure 4A:
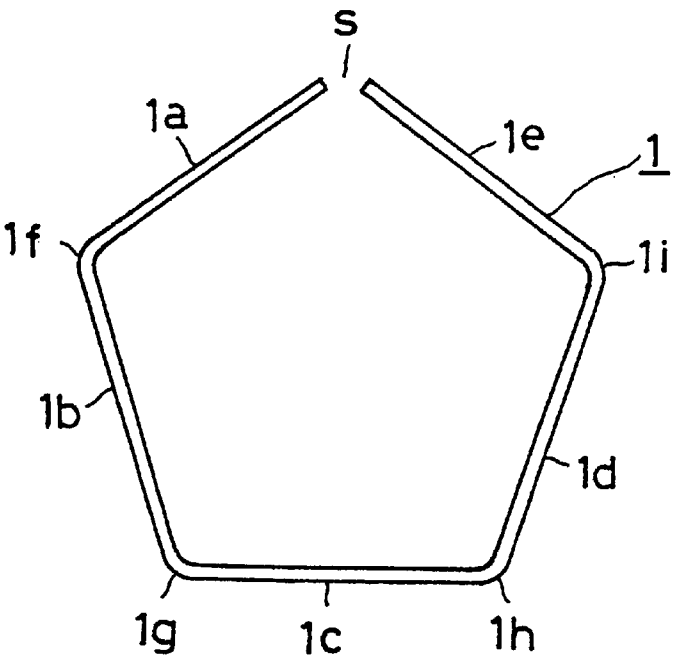
FIG. 4A is an end view showing a shaped article to be unfolded according to the first embodiment.
Figure 4B:
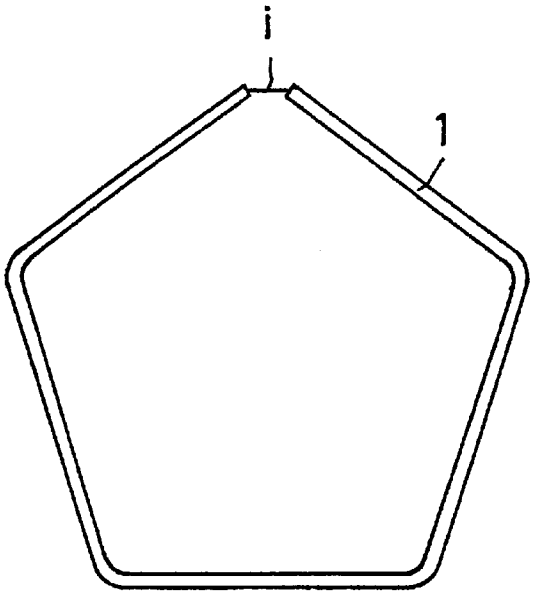
FIG. 4B is an end view showing an extruded article to become the shaped material.
Figure 4C:
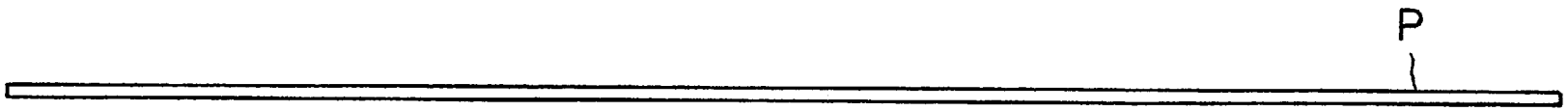
FIG. 4C is an end view showing an unfolded article.

A shaped article to be unfolded is a cylindrical aluminum extruded article 1 having a pentagonal cross-section. As shown in FIG. 4A, the shaped article 1 comprises five flat portions, i.e., a first flat portion 1*a*, a second flat portion 1*b* connected to the first flat portion 1*a* by a bent portion 1*f*, a third flat portion 1*c* connected to the second flat portion 1*b* by a bent portion 1*g*, a fourth flat portion 1*d* connected to the third flat portion 1*c* by a bent portion 1*h* and a fifth flat portion 1*e* connected to the fourth flat portion 1*e* by a bent portion 1*i*. The first flat portion 1*a* and the fifth flat portion 1*e* are not connected but are divided by a slit s formed therebetween. The shaped article 1 is formed by extruding a hollow extruded article 1 having an imitation portion i formed on one of five vertexes as shown in FIG. 4B and then removing the imitation portion i. The length of the shaped article 1 is, for example, about 20 meters or so. A device for unfolding the shaped article 1 according to this embodiment is designed so as to unfold the shaped article 1 into a flat unfolded article P as shown in FIG. 4C.

In FIG. 2, showing the device for unfolding a shaped article, the numerals 3*a*, 3*b*, 3*c*, 3*d*, 3*e* denote a first to fifth absorbing means, respectively. The device is equipped with a driving mechanism 4 for drive the first to fifth absorbing means 3*a*, 3*b*, 3*c*, 3*d*, 3*e* to act unfolding operations.

The first to fifth absorbing means 3*a*, 3*b*, 3*c*, 3*d*, 3*e* are provided in accordance with the first to fifth flat portion 1*a*, 1*b*, 1*c*, 1*d*, 1*e* of the shaped article 1. Each absorbing means 3*a*, 3*b*, 3*c*, 3*d*, 3*e* is designed to absorb an outer surface of the corresponding flat portion 1*a*, 1*b*, 1*c*, 1*d*, 1*e* of the shaped article 1.

Figure 1A:
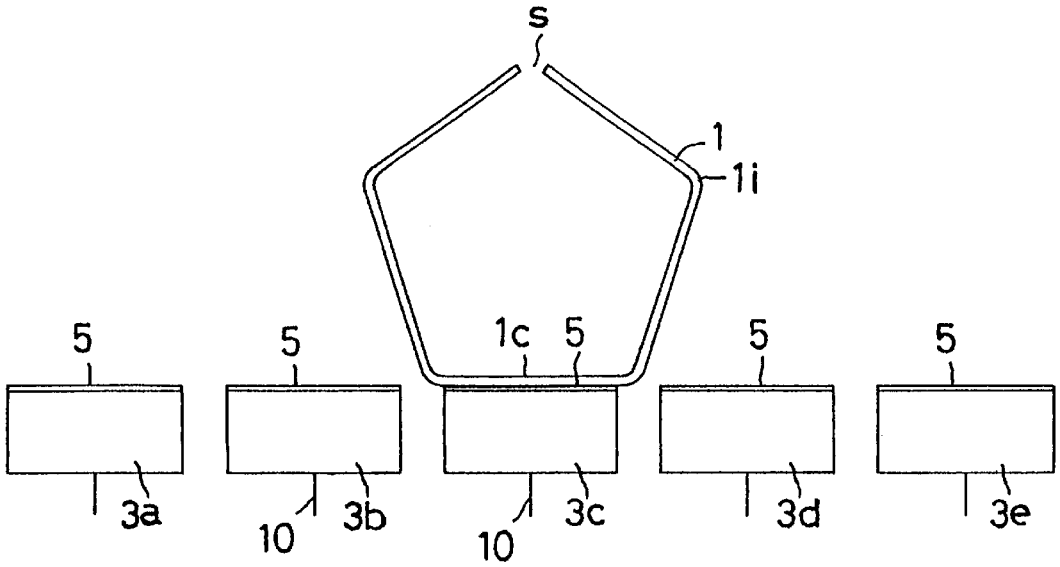
FIGS. 1A to 1C are end views showing unfolding steps of a shaped article by using a device for unfolding the shaped article according to a first embodiment of the present invention.
Figure 1B:
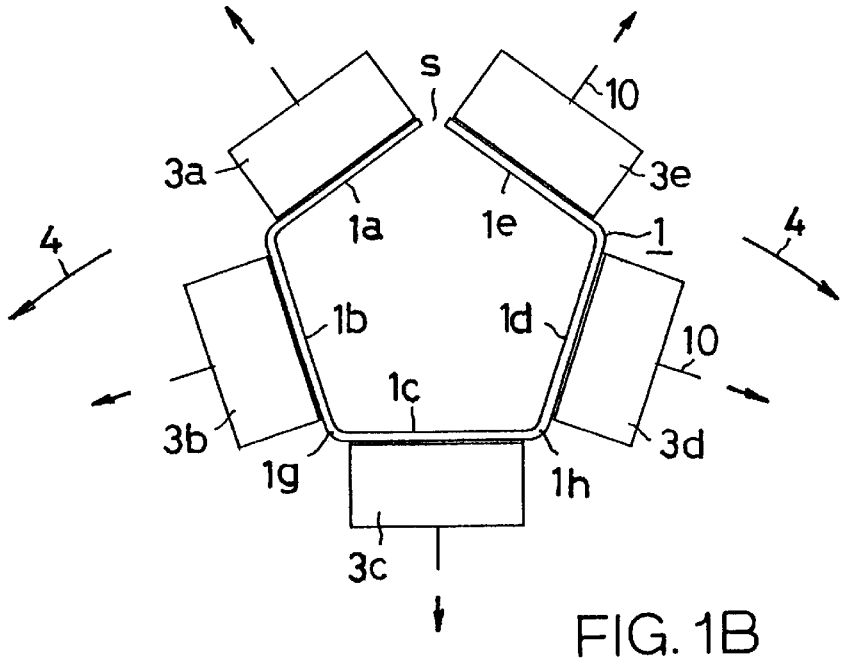

Each absorbing means 3*a*, 3*b*, 3*c*, 3*d*, 3*e* has a rectangular absorbing portion 5 having a length approximately equal to the length of the shaped article 1 and a width approximately equal to the width of each corresponding flat portion 1*a*, 1*b*, 1*c*, 1*d*, 1*e*, as shown in FIG. 1B, so as to hold the shaped article 1 by absorbing (i.e., vacuum suctioning) approximately the whole area of the outer surfaces of the flat portions 1*a*, 1*b*, 1*c*, 1*d*, 1*e* because of the following reasons. One of the reasons is to hold the shaped article 1 with sufficient absorbing force of each absorbing means 3*a*, 3*b*, 3*c*, 3*d*, 3*e* during the unfolding operations by keeping as large an absorbing area as possible. The other reason is to enable effective plastic transformation to the bent portions 1*f*, 1*g*, 1*h*, 1*i* of the shaped article 1 by absorbing each flat portion 1*a*, 1*b*, 1*c*, 1*d*, 1*e* including an area adjacent to the bent portions 1*f*, 1*g*, 1*h*, 1*i*.

Each absorbing means 3*a*, 3*b*, 3*c*, 3*d*, 3*e* may be divided along the length of the shaped article 1 into a plurality of divided absorbing means to vacuum absorb each flat portion 1*a*, 1*b*, 1*c*, 1*d*, 1*e* of the shaped article 1. By dividing the absorbing means as mentioned above, various lengths of shaped articles can be unfolded by adjusting the number of the divided absorbing means to be positioned along the length of the shaped article 1.

Figure 3:
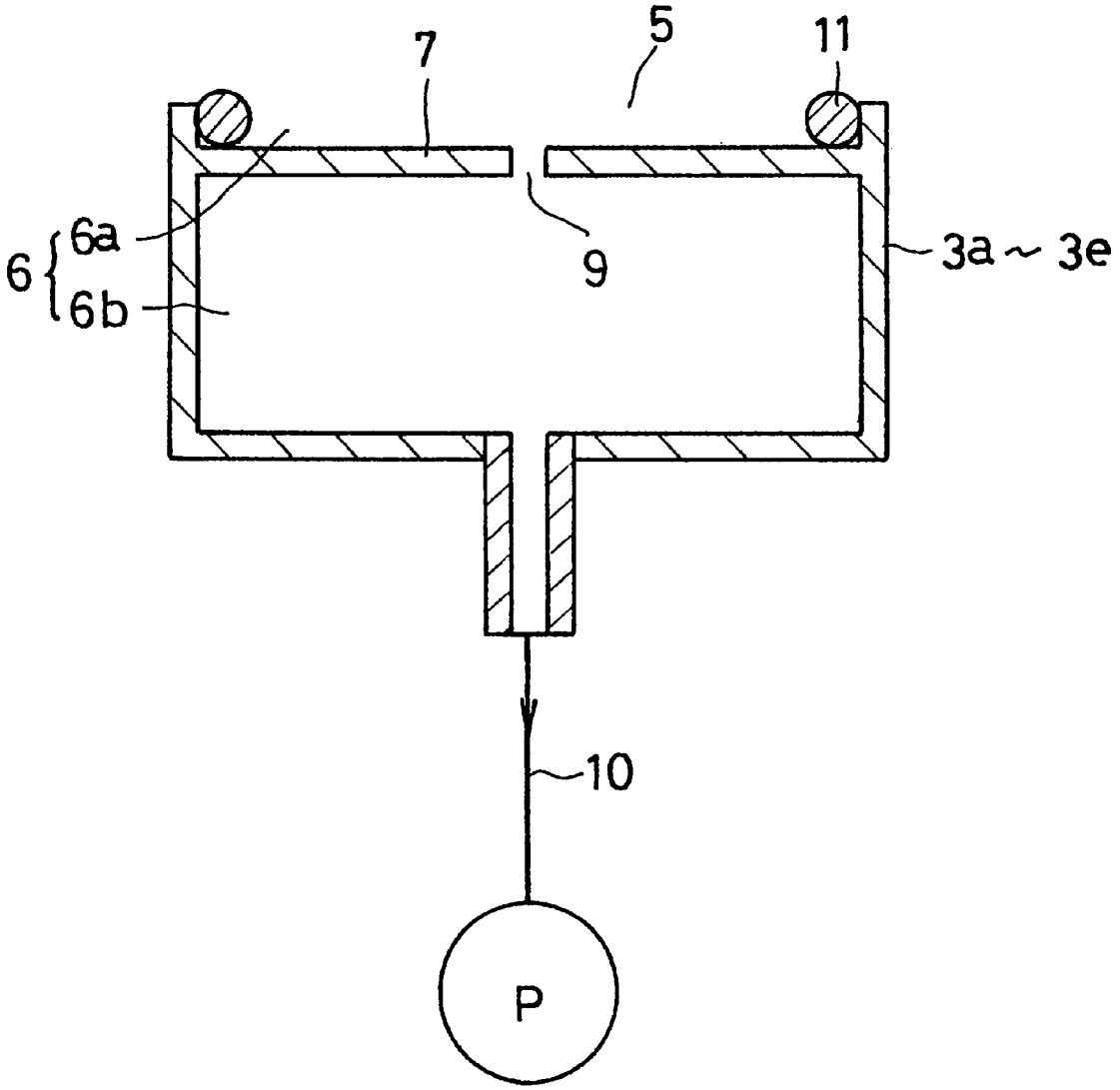
FIG. 3 is a cross-sectional view showing the inner structure of the absorbing means.

As shown in FIG. 3, each absorbing means 3*a*, 3*b*, 3*c*, 3*d*, 3*e* includes a vacuum chamber 6 which opens toward an absorbing portion 5. The vacuum chamber 6 is divided by a partition 7 into an outside chamber 6*a* located toward the absorbing portion 5 and an inside chamber 6*b*. The partition 7 is placed such that the outside chamber 6*a* has a shallow bottom and the inside chamber 6*b* has a large volume. A communication port 9 is formed in the partition 7 so as to communicate the outside chamber 6*a* with the inside chamber 6*b*. A vacuuming device 10, such as a vacuum pump, is connected to the inside chamber 6*b* such that the inside chamber 6*b* and the outside chamber 6*a* are decompressed to absorb the flat portions 1*a*, 1*b*, 1*c*, 1*d*, 1*e* of the shaped article 1. The above structure of the vacuum chamber 6 which is divided into two divisional chambers 6*a*, 6*b* is designed to attain a smooth absorbing operation. A packing, or sealing, ring 11 is disposed around the inner peripheral portion of the outside chamber 6*a*.

Figure 2B:
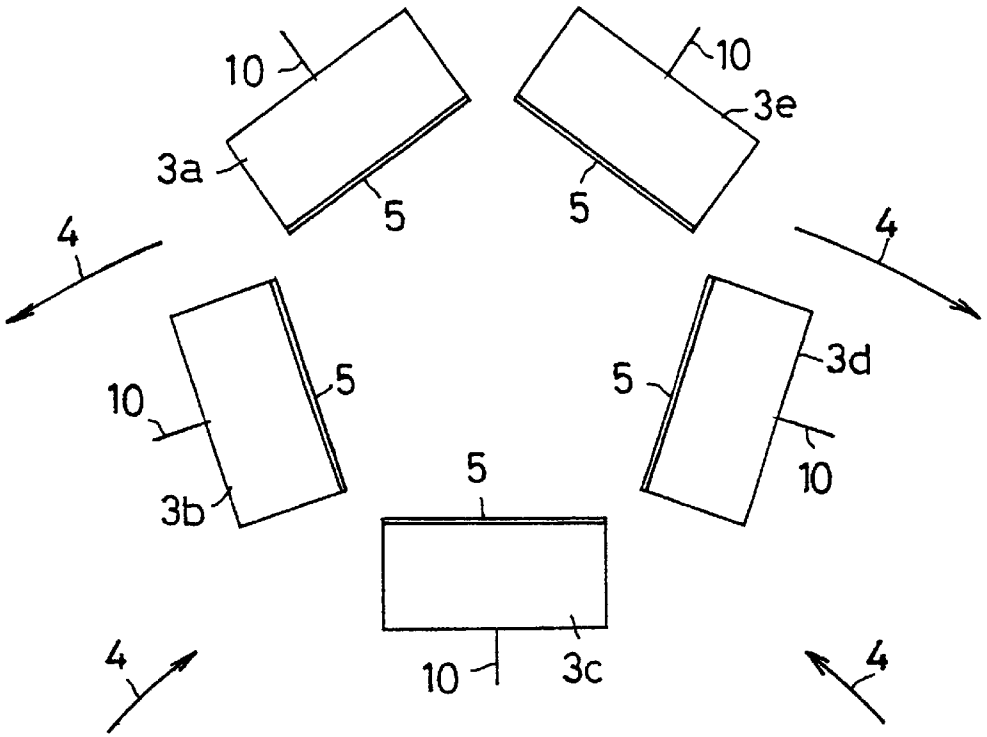
Figure 2A:
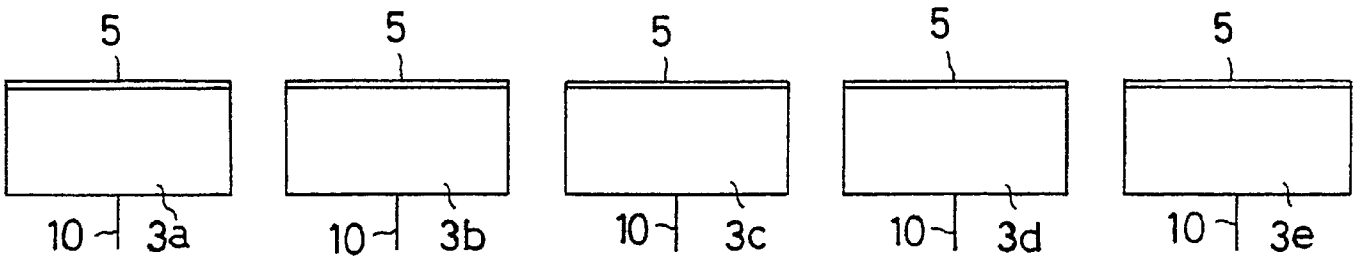

As mentioned above, the driving mechanism 4 is used to drive the above mentioned five absorbing means 3*a*, 3*b*, 3*c*, 3*d*, 3*e* and to change their positions between two positions, i.e., a first position and a second position, as shown in FIG. 2. In the first position, i.e., an opened position, five absorbing means 3*a*, 3*b*, 3*c*, 3*d*, 3*e* stand in row with each absorbing portion 5 facing up, as shown in FIG. 2A. In the second position, i.e., a closed position, each absorbing means 3*a*, 3*b*, 3*c*, 3*d*, 3*e* is positioned on each side of an equilateral pentagon, as shown in FIG. 2B. To change the positions from the opened position to the closed position, the second and fourth absorbing means 3*b*, 3*d* each adjacent to the central absorbing means, i.e., third absorbing means 3*c*, are rotated by 72 degrees against the third absorbing means 3*c*, respectively, and the first and fifth absorbing means 3*a*, 3*e* each adjacent to the second and fourth absorbing means 3*b*, 3*d*, respectively, are rotated by 72 degrees against the second and forth absorbing means 3*b*, 3*d*, respectively. Changing the positions from the closed position to the opened position can be done in a manner opposite to the above. The working of the driving mechanism 4 can be performed by synchronously operated gear mechanisms, or the like, each located at both ends of each absorbing means 3*a*, 3*b*, 3*c*, 3*d*.

Figure 1C:
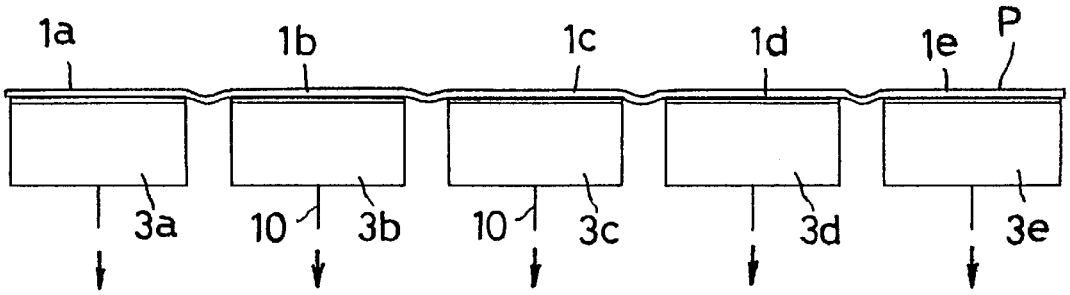

In the device for unfolding a shaped article, the shaped article 1 will be unfolded as follows. In an opened position of the absorbing means 3*a*, 3*b*, 3*c*, 3*d*, 3*e*, a third flat portion 1*c* of the shaped article 1 is placed on the third absorbing means 3*c* with the slit portion s facing up, as shown in FIG. 1A. Thereafter, as shown in FIG. 1B, the first to fifth absorbing means 3*a*, 3*b*, 3*c*, 3*d*, 3*e* are moved from the opened position to the closed position so as to fit each absorbing portion 5 of the first to fifth absorbing means 3*a*, 3*b*, 3*c*, 3*d*, 3*e* on the corresponding outer surface of the first to fifth flat portion 1*a*, 1*b*, 1*c*, 1*d*, 1*e* of the shaped article 1. Then, each absorbing means 3*a*, 3*b*, 3*c*, 3*d*, 3*e* absorbs to hold the outer surface of each flat portion 1*a*, 1*b*, 1*c*, 1*d*, 1*e*. Thereafter, as shown in FIG. 1*c*, the first to fifth absorbing means 3*a*, 3*b*, 3*c*, 3*d*, 3*e* are driven toward their opened position. As a result, the second and forth flat portions 1*b*, 1*d* are unfolded by 72 degrees against the third flat portion 1*c* about the bent portions 1*g*, 1*h*, respectively, and the first and fifth flat portions 1*a*, 1*e* are unfolded by 72 degrees against the second and forth flat portions 1*b*, 1*d* about the bent portions 1*f*, 1*i*, respectively. Thus, the above mentioned equilateral pentagonal hollow aluminum extruded article 1 having a slit s along the length thereof is unfolded into a wide flat plate-like unfolded article P.

Thereafter, the vacuum-absorbing operation is released to detach the unfolded article P, and then next shaped article 1 to be unfolded is set in the same manner as mentioned above.

As clearly understood form the above explanation, in the device for unfolding a shaped article 1 mentioned above, a vacuum-type absorbing means 3*c* absorbs to hold, i.e., applies suction to, one side portion 1*c* adjacent to a bent portion 1*g* of a shaped article 1, and a vacuum-type absorbing means 3*b* absorbs to hold the other side portion 1*b* adjacent to the bent portion 1*g*, and then each absorbing means 3*b*, 3*c* is driven to unfold both side portions 1*b*, 1*c* of the shaped article 1 about the bent portion 1*g*. Therefore, a shaped metal article 1 having a longitudinal bent portion 1*g* can be unfolded at high efficiency by the device. The device can be effectively used to roughly unfold a shaped article.

Further, each absorbing means 3*a*, 3*b*, 3*c*, 3*d*, 3*e* has a rectangular absorbing portion 5 having a length approximately equal to the length of the extruded shaped article 1 and a width approximately equal to the width of each flat portion 1*a*, 1*b*, 1*c*, 1*d*, 1*e* of the extruded shaped article 1 so as to absorb and hold almost the whole area of the outer surface of each flat portion 1*a*, 1*b*, 1*c*, 1*d*, 1*e* of the extruded shaped article 1. Therefore, during the unfolding procedures, each absorbing means 3*a*, 3*b*, 3*c*, 3*d*, 3*e* can hold the article 1 with enough absorbing force by keeping as large absorbing area as possible, and can enable effective plastic transformation to the bent portion 1*f*, 1*g*, 1*h*, 1*i* of the shaped article 1 by absorbing each flat portion 1*a*, 1*b*, 1*c*, 1*d*, 1*e* including an area adjacent to the bent portion 1*f*, 1*g*, 1*h*, 1*i*. As a result, an effective unfolding processing can be performed.

Further, in this embodiment, the shaped article 1 to be unfolded is a shaped article having a plurality of longitudinal bent portions 1*f*, 1*g*, 1*h*, 1*i* and the number of the vacuum absorbing means 3*a*, 3*b*, 3*c*, 3*d*, 3*e* corresponds to the number of flat portions 1*a*, 1*b*, 1*c*, 1*d*, 1*e*. And each flat portion 1*a*, 1*b*, 1*c*, 1*d*, 1*e* of the shaped article 1 is simultaneously unfolded by the absorbing means 3*a*, 3*b*, 3*c*, 3*d*, 3*e* each absorbing a corresponding flat portion 1*a*, 1*b*, 1*c*, 1*d*, 1*e*. Therefore, the shaped article 1 can be unfolded into a flat late by one unfolding operation with high efficiency, as compared to a conventional unfolding operation in which each bent portion 1*f*, 1*g*, 1*h*, 1*i* is unfolded one after the other.

Because the device is designed to unfold a shaped article 1 by vacuum absorbing, even if the shaped article 1 is a hollow article having a longitudinal slit s, the device can firmly hold flat portions on both sides of a bent portion. Thus, the shaped article 1 can be unfolded by this device without having a complex mechanism and structure.

Though the above embodiment is shown as one of the preferred embodiments, the present invention is not limited to the above embodiment and as would be apparent to those skilled in the art, various substitutions and modifications within the scope and spirit of the invention are contemplated. For example, in the above mentioned embodiment, though the shaped article to be unfolded is a pentagonal cylindrical shaped article and the device is provided with five vacuum absorbing means corresponding to the number of flat portions, the device may be provided with two vacuum absorbing means to unfold each bent portion of the shaped article one after the other. Further, the device may be provided with one vacuum absorbing means for absorbing one flat portion and a holding means other than a vacuum absorbing means for holding the other flat portion.

Furthermore, a shaped article to be unfolded by the device is not limited to the above if the article has at least on longitudinal bent potion. Such a bent portion may be a V-shaped or a U-shaped portion. In the embodiment mentioned above, the shaped article is shown as an extruded shaped article, but various kinds of articles other than extruded articles can be applied. In the above mentioned embodiment, every bent portion of the shaped article is completely unfolded, but each bent portion may be unfolded so as to have a certain angle. In the above mentioned embodiment, each absorbing means 3*a*, 3*b*, 3*c*, 3*d*, 3*e* is formed to be one piece along the length of the article, but each absorbing means 3*a*, 3*b*, 3*c*, 3*d*, 3*e* may be divided along the length of the article into a plurality of separate absorbing means.

As mentioned above, the device according to the above mentioned embodiment includes a vacuum-type absorbing means for absorbing one side portion located at one side of the bent portion, a vacuum-type absorbing means for absorbing the other side portion located at the other side of the bent portion and a driving means for moving the absorbing means such that the side portions each absorbed by the absorbing means are moved to be unfolded along the bent portion. Therefore, by moving each vacuum-type absorbing mean which absorbs each side portion of the shaped metal article to unfold them along the bent portion, the shaped metal article can be unfolded to be a desired unfolded shape with a high efficiency. The method for unfolding a shaped article can attain the same effects as mentioned above.

(Second Embodiment)

Figure 9A:
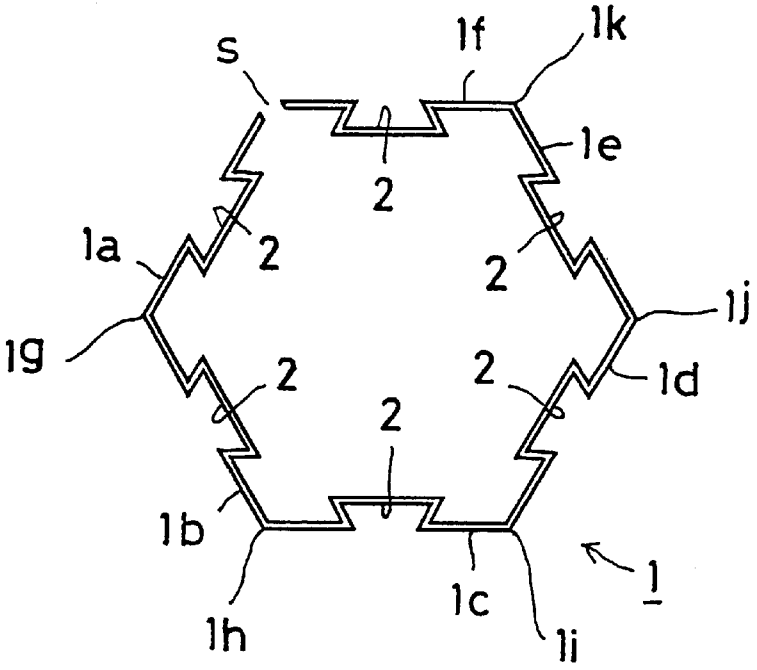
FIG. 9A is an end view showing a shaped article to be unfolded according to the second embodiment.
Figure 9B:
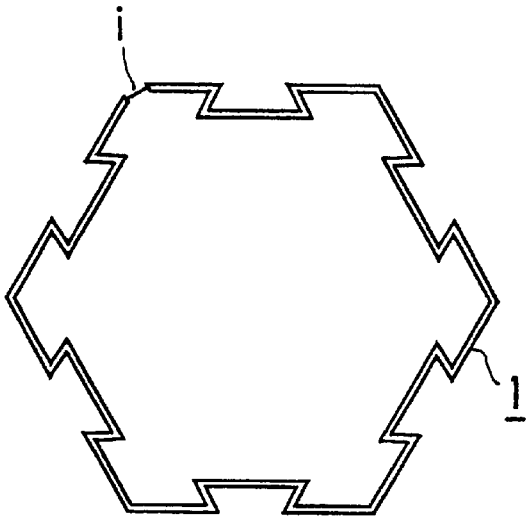
FIG. 9B is an end view showing an extruded article to become the shaped material.
Figure 9C:
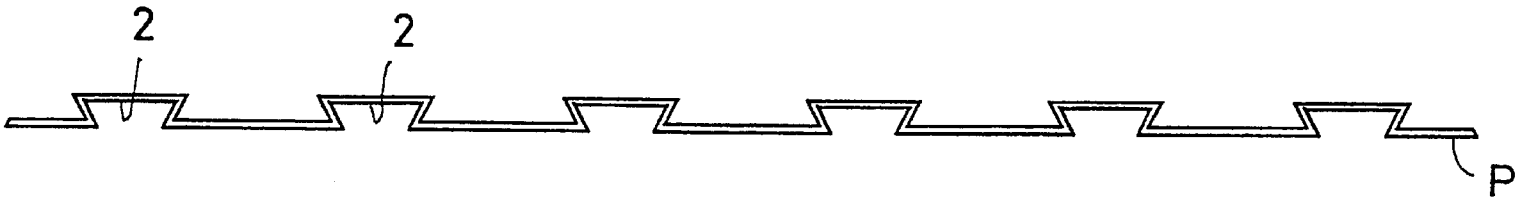
FIG. 9C is an end view of the shaped article in an unfolded state.

A shaped article be unfolded is a cylindrical aluminum extruded article having a hexangular cross-section. As shown in FIG. 9A, the shaped article 1 comprises six side portions, i.e., a first side portion 1*a*, a second side portion 1*b* connected to the first side portion 1*a* by a bent portion 1*g*, a third side portion 1*c* connected to the second side portion 1*b* by a bent portion 1*h*, a fourth side portion 1*d* connected to the third side portion 1*c* by a bent portion 1*i*, a fifth side portion 1*e* connected to the fourth side portion 1*d* by a bent portion 1*j* and a sixth side portion 1*f* connected to the fifth side portion 1*e* by a bent portion 1*k*. The first side portion 1*a* and the sixth side portion 1*f* are not connected, but are divided by a slit s formed therebetween. Each side portion 1*a*, 1*b*, 1*c*, 1*d*, 1*e*, 1*f* has, at its central portion in the direction of the width, an inwardly dented portion 2 formed along the whole length of the side portion for fixing a bolt, or the like. Each dented portion 2 is formed to be a trapezoidal shape in cross-section having inclined side portions 2*a* widening toward the bottom portion 2*b*. The shaped extruded article 1 is formed by extruding a hollow extruded article 1 having a hexangular shape in cross section and having an imitation portion i formed on one of six vertexes as shown in FIG. 9B and then removing the imitation portion i. The length of the shaped article 1 is, for example, about 20 meters or so. A device for unfolding the shaped article 1 according to this embodiment is designed so as to unfold the shaped article 1 into a flat unfolded article P as shown in FIG. 9C.

Figure 6A:
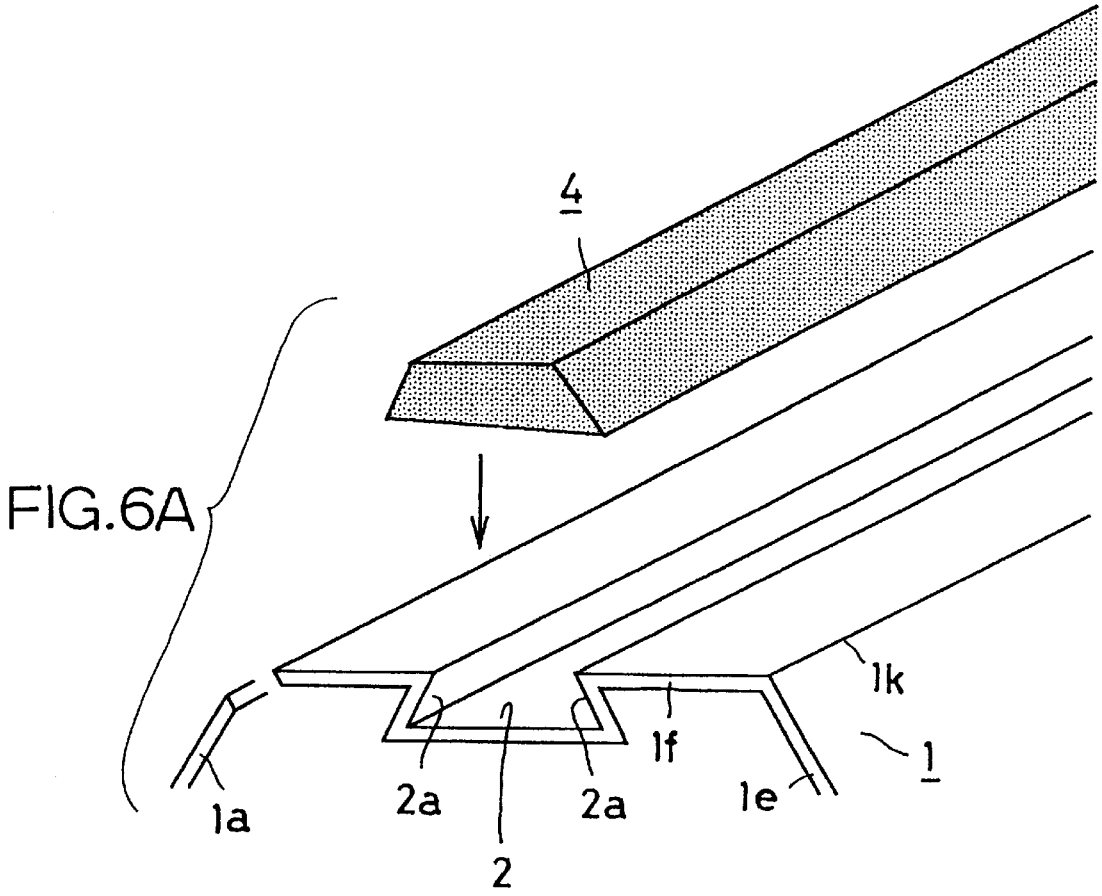
FIG. 6A is a perspective view showing the shaped article and a filler material shown in FIGS. 5A to 5C in the disassembled state.
Figure 6B:
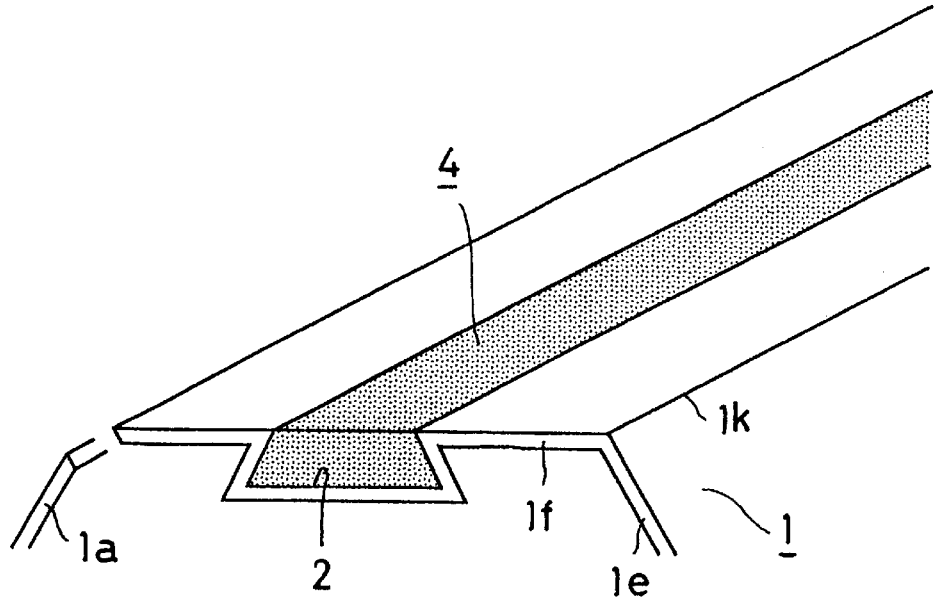
FIG. 6B is a perspective view showing the shaped article and the filler material fitted therein.

A seal member 4 is of a trapezoidal shape in cross section which corresponds to the cross-section of the dented portion 2 so as to be closely fitted in the dented portion 2, as shown in FIGS. 6A and 6B. Each seal member 4 is made of an elastic material such as rubber or soft resin. Each seal member 4 has a length corresponding to the length of the shaped article 1 to be fitted in the dented portion 2 of the shaped article 1 along the whole length thereof.

Figure 5B:
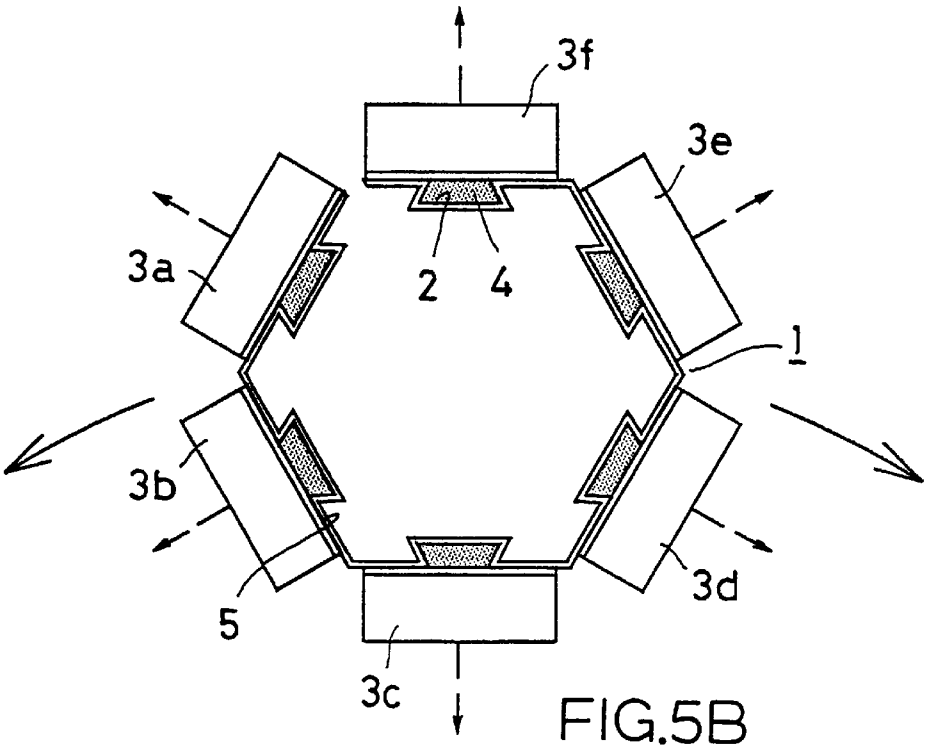
Figure 5A:
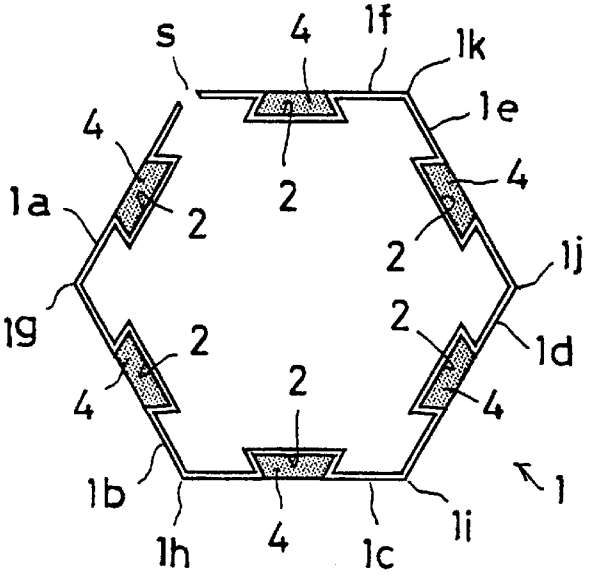
Figure 5C:
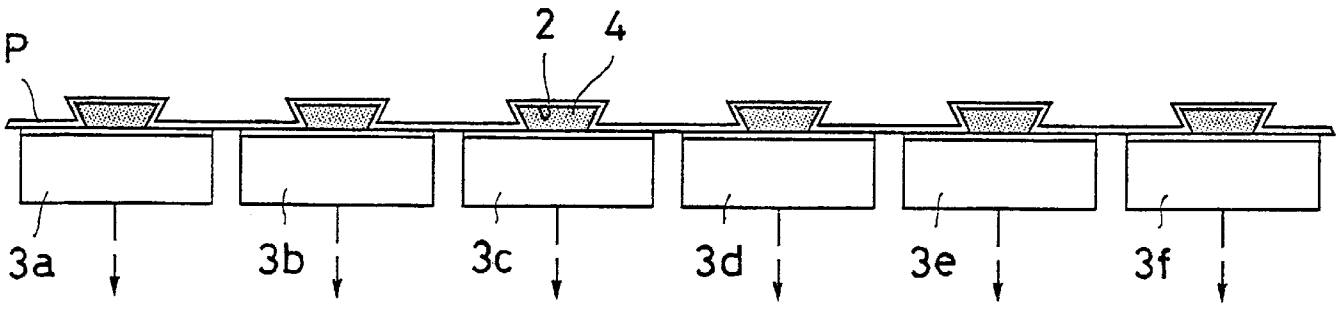

As shown in FIGS. 5B and 5C, the device for unfolding the shaped article 1 mentioned above is a vacuum-type device and is equipped with six absorbing means, i.e., the first to sixth vacuum-type absorbing means 3*a*, 3*b*, 3*c*, 3*d*, 3*e*, 3*f* and driving mechanism 4 for driving these absorbing means (not shown) to conduct the unfolding operation.

The first to sixth absorbing means 3*a*, 3*b*, 3*c*, 3*d*, 3*e*, 3*f* are provided in accordance with the first to sixth side portion 1*a*, 1*b*, 1*c*, 1*d*, 1*e*, 1*f* of the shaped article 1. Each absorbing means 3*a*, 3*b*, 3*c*, 3*d*, 3*e*, 3*f* is designed to absorb an outer surface of the corresponding side portion 1*a*, 1*b*, 1*c*, 1*d*, 1*e*, 1*f* of the shaped article 1.

Since the structure of each absorbing means 3*a*, 3*b*, 3*c*, 3*d*, 3*e*, 3*f* is the same as the absorbing means of the first embodiment shown in FIG. 3, an explanation thereof is omitted.

As mentioned above, the driving mechanism 4 is used to move the above mentioned six absorbing means 3*a*, 3*b*, 3*c*, 3*d*, 3*e*, 3*f* and to change their positions between two positions, i.e., a first position and a second position. In the first position, i.e., an opened position, six absorbing means 3*a*, 3*b*, 3*c*, 3*d*, 3*e*, 3*f* stand in row with each absorbing portion 5 facing up. In the second position, i.e., a closed position, each absorbing means 3*a*, 3*b*, 3*c*, 3*d*, 3*e* is positioned on each side of a hexagon. To change the positions from the opened position to the closed position, the second and fourth absorbing means 3*b*, 3*d* each adjacent to the central absorbing means, i.e., third absorbing means 3*c*, are rotated by 60 degrees against the third absorbing means 3*c*, respectively, and the second and fifth absorbing means 3*a*, 3*e* each adjacent to the second and fourth absorbing means 3*b*, 3*d*, respectively, are rotated by 60 degrees against the second and fourth absorbing means 3*b*, 3*d*, respectively, and that the sixth absorbing means 3*f* is rotated by 60 degrees against the fifth absorbing means 3*e*. Changing the positions from the closed position to the opened position can be done in a manner opposite to the above. The working of the driving mechanism 4 can be performed by synchronously operated gear mechanisms, or the like, each located at both ends of each absorbing means 3*a*, 3*b*, 3*c*, 3*d*, 3*e*, 3*f*.

In the device for unfolding a shaped article, the shaped article 1 will be unfolded as follows. As shown in FIGS. 5A, 6A and 6B, the seal members 4 are fitted in the dented portions 2 of the shaped article 1. Since the seal member 4 is made of an elastic material such as rubber or soft resin, the seal member 4 can be easily fitted in the dented portion 2 because of its elasticity.

Figure 7A:
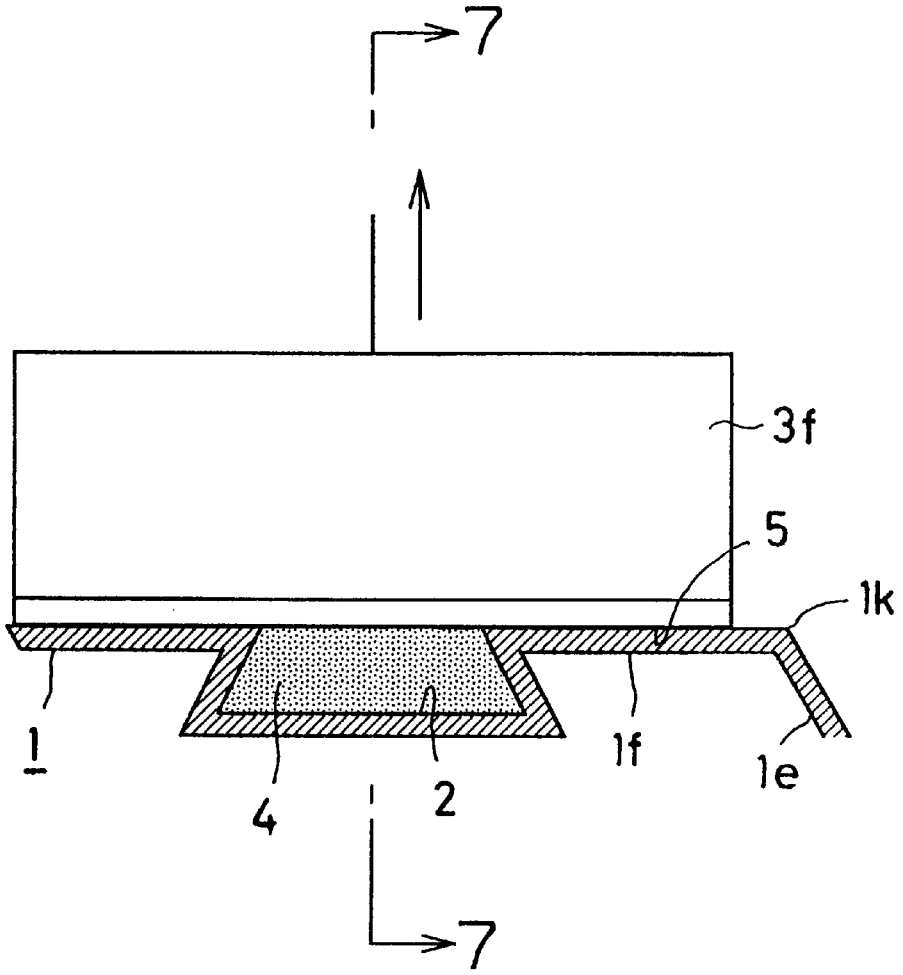
FIG. 7A is a cross-sectional view showing the state of absorbing the shaped article shown in FIGS. 6A and 6B by a vacuum-type absorbing means.
Figure 7B:
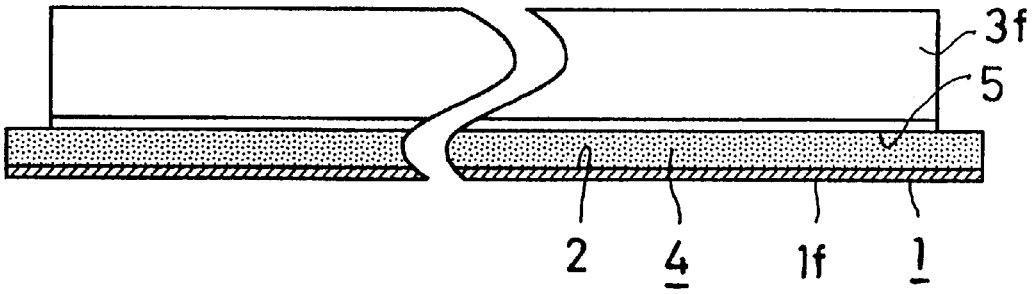
FIG. 7B is a cross-sectional view taken along the line 7—7 of FIG. 7A.

Next, the shaped article 1 is set in the device. That is, in an opened position of the absorbing means 3*a*, 3*b*, 3*c*, 3*d*, 3*e*, 3*f*, a third flat portion 1*c* of the shaped article 1 is placed on the absorbing portion 5 of the third absorbing means 3*c* with the slit portion s facing up. Thereafter, as shown in FIG. 5B, the first to sixth absorbing means 3*a*, 3*b*, 3*c*, 3*d*, 3*e*, 3*f* are moved from the opened position to the closed position so as to fit each absorbing portion 5 of the first to sixth absorbing means 3*a*, 3*b*, 3*c*, 3*d*, 3*e*, 3*f* on corresponding outer surface of the first to sixth flat portion 1*a*, 1*b*, 1*c*, 1*d*, 1*e*, 1*f* of the shaped article 1 with each absorbing means 3*a*, 3*b*, 3*c*, 3*d*, 3*e*, 3*f* crossing over each dented portion 2. Then, each absorbing means 3*a*, 3*b*, 3*c*, 3*d*, 3*e*, 3*f* absorbs to hold the outer surface of each flat portion 1*a*, 1*b*, 1*c*, 1*d*, 1*e*, 1*f*. As shown in FIG. 7B, a space formed between the absorbing means 3*a*, 3*b*, 3*c*, 3*d*, 3*e*, 3*f* and the side portion 1*a*, 1*b*, 1*c*, 1*d*, 1*e*, 1*f* is filled up with the seal member 4. Therefore, each side portion 1*a*, 1*b*, 1*c*, 1*d*, 1*e*, 1*f* can be firmly absorbed and held by each absorbing means 3*a*, 3*b*, 3*c*, 3*d*, 3*e*, 3*f*, even if each absorbing means 3*a*, 3*b*, 3*c*, 3*d*, 3*e*, 3*f* is placed on each side portion 1*a*, 1*b*, 1*c*, 1*d*, 1*e*, 1*f* with each absorbing means 3*a*, 3*b*, 3*c*, 3*d*, 3*e*, 3*f* crossing over each dented portion 2. Especially, since a seal member 4 made of elastic materials such as rubber or soft resin is closely fitted in the dented portion 2 of the shaped article 1, an excellent sealing performance can be obtained by the elasticity of the seal member 4, and, therefore, the shaped article 1 can be firmly held by the absorbing means.

Thereafter, as shown in FIG. 5C, the first to sixth absorbing means 3*a*, 3*b*, 3*c*, 3*d*, 3*e*, 3*f* are driven toward their opened position. As a result, the second and fourth side portions 1*b*, 1*d* are unfolded by 60 degrees against the third flat portion 1*c* about the bent portions 1*h*, 1*i*, respectively, and the first and fifth flat portions 1*a*, 1*e* are unfolded by 60 degrees against the second and fourth side portions 1*b*, 1*d* about the bent portions 1*g*, 1*j*, respectively, and the sixth side portion 1*f* is unfolded by 60 degrees against the fifth side portion 1*e* about the bent portions 1*k*. Thus, the above mentioned extruded article 1 is unfolded into a wide flat plate-like unfolded article P. Thereafter, the vacuum-absorbing operation is released to detach the unfolded article P and the seal member 4 is removed from the unfolded article P.

Figure 8A:
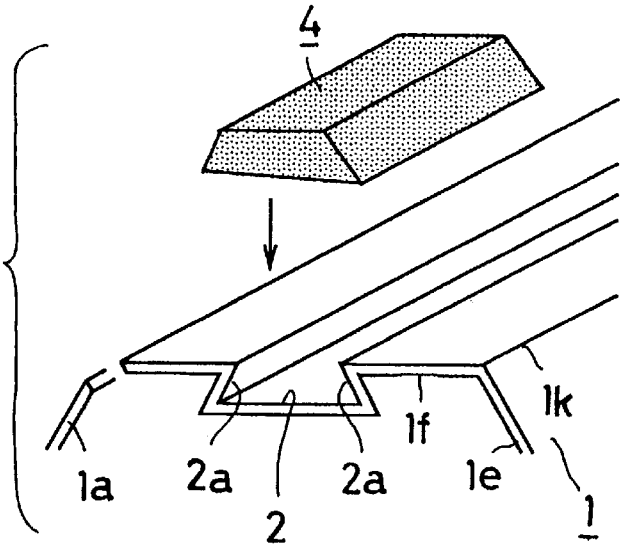
Figure 8B:
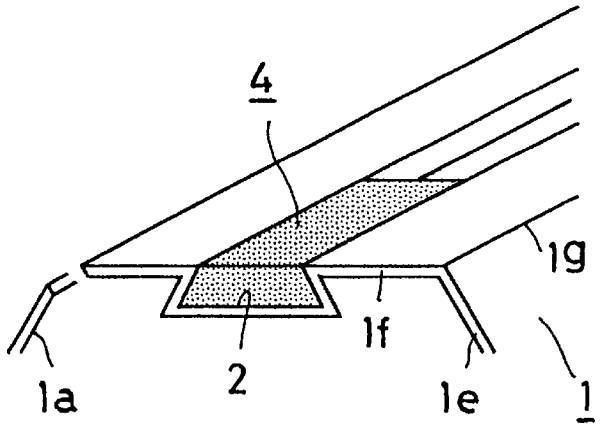
Figure 8C:
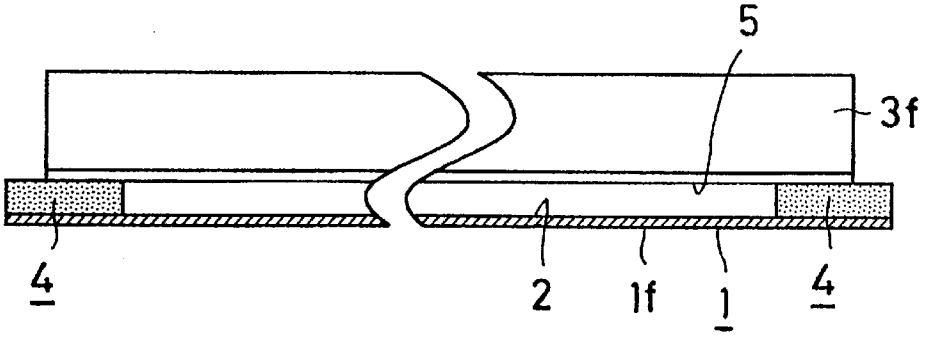

Though the second embodiment according to the present invention is described above, the present invention is not limited to that above. In the above mentioned embodiment, the seal member 4 is fitted in the dented portion 2 of the shaped article 1 along the whole length thereof, but as shown in FIGS. 8A to 8C, short length seal members 4 may be partially fitted in the dented portion 2 so as to enable vacuum absorbing. The cross-sectional shape of the dented portion 2 of the shaped article 1 is not specifically limited, and may be modified into various kinds of shapes. In the second embodiment, the hollow shaped article 1 having an hexagonal cross-section is to be unfolded by six vacuum-type absorbing means 3*a*, 3*b*, 3*c*, 3*d*, 3*e*, 3*f* corresponding to the first to sixth side portions 1*a*, 1*b*, 1*c*, 1*d*, 1*e*, 1*f*. However, each bent portion 1*g*, 1*h*, 1*i*, 1*j*, 1*k* may be unfolded one after the other by a pair of vacuum-type absorbing means. Further, a shaped article to be unfolded is not limited to the above. The shaped article may comprise a pair of side portions, a bent portion connecting the side portions and a dented portion formed on at least one of the side portions. Furthermore, a shaped article may be a V-shaped article which includes a pair of side portions and a bent portion connecting them.

In the method for unfolding a shaped article according to the second embodiment, the method includes the steps of fitting a seal member in a dented portion formed on a side portion before placing a vacuum absorbing means on a side portion with the absorbing means crossing over the dented portion, and absorbing the side portion by the absorbing means with the absorbing means crossing over the dented portion. Since a space formed between the absorbing means and the side portion of the shaped article is sealed by the seal member, the absorbing means can firmly hold the side portion even if the absorbing means is placed on the side portion with the absorbing means crossing over the dented portion. As a result, even if a shaped metal article has a dented portion formed on an outer surface of at least one of the side portions, the shaped metal article can be unfolded by the vacuum absorbing method.

Adapting an elastic material as a seal member can enhance sealing performance and reliability of unfolding procedures.

(Third Embodiment)

Figure 12A:
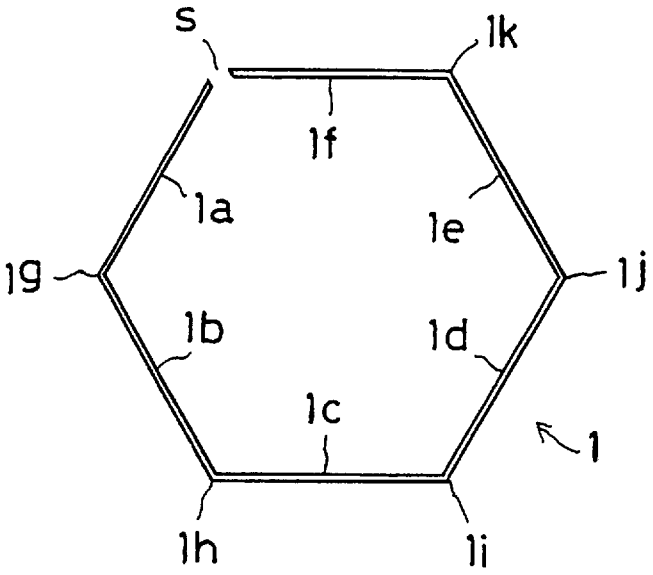
FIG. 12A is an end view showing a shaped article to be unfolded according to the third embodiment.
Figure 12B:
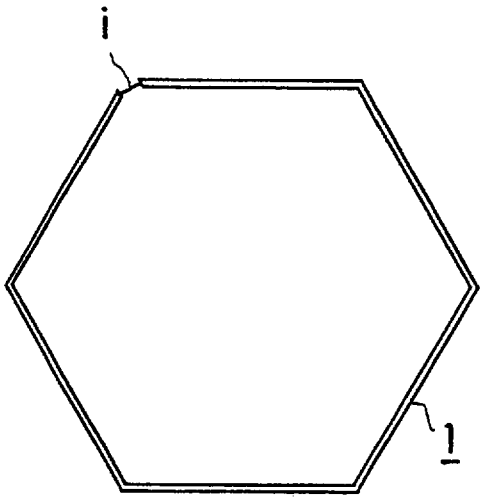
FIG. 12B is an end view showing an extruded article to become the shaped material.
Figure 12C:
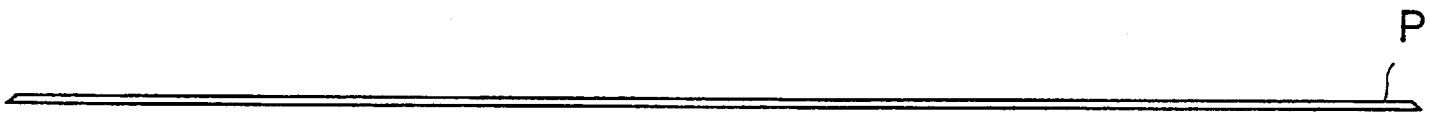
FIG. 12C is an end view showing an unfolded article.

In the third embodiment, a shaped article to be unfolded is a cylindrical aluminum extruded article having a hexangular cross-section. As shown in FIG. 12, the shaped article 1 comprises six side portions, i.e., a first side portion 1*a*, a second side portion 1*b* connected to the first side portion 1*a* by a bent portion 1*g*, a third side portion 1*c* connected to the second side portion 1*b* by a bent portion 1*h*, a fourth side portion 1*d* connected to the third side portion 1*c* by a bent portion 1*i*, a fifth side portion 1*e* connected to the fourth side portion 1*d* by a bent portion 1*j* and a sixth side portion 1*f* connected to the fifth side portion 1*e* by a bent portion 1*k*. The first side portion 1*a* and the sixth side portion 1*f* are not connected, but divided by a slit s formed therebetween.

Figure 10A:
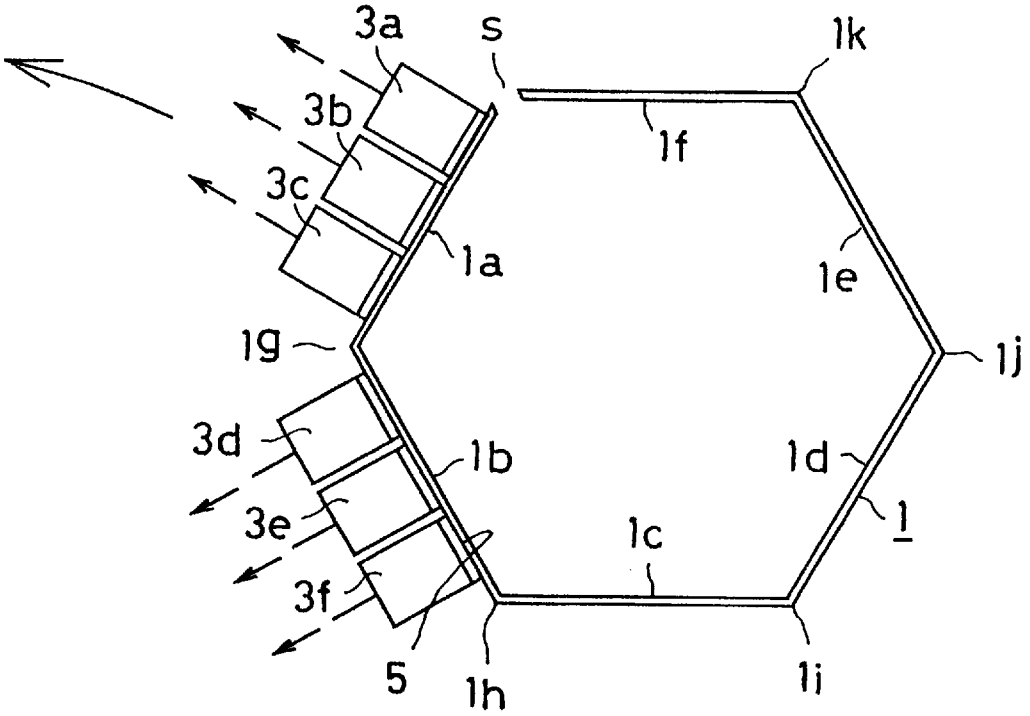
Figure 10B:
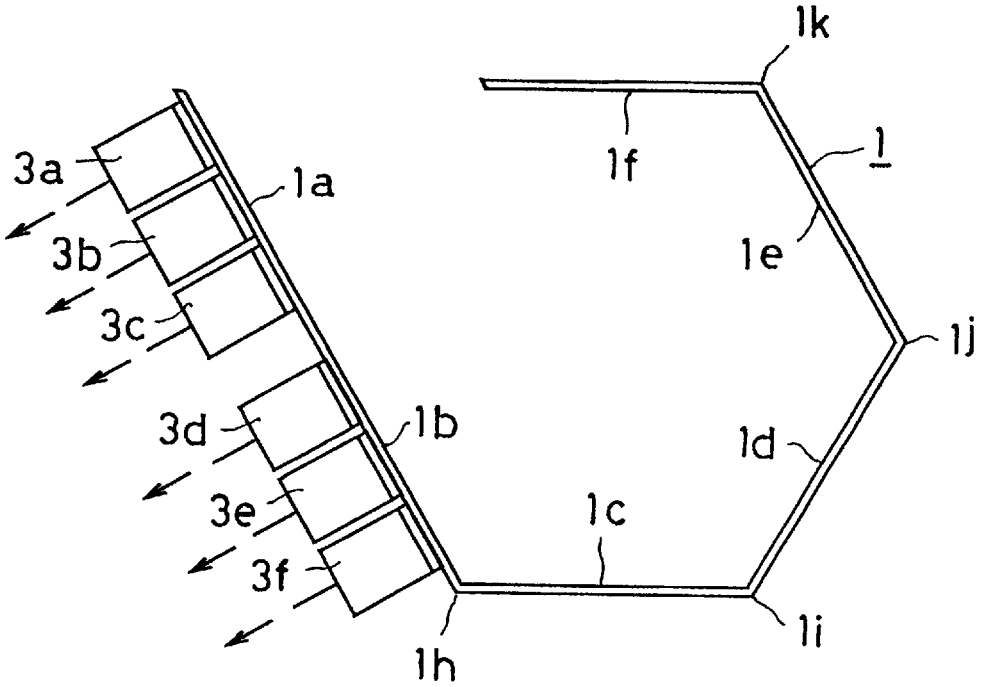

As shown in FIGS. 10A and 10B, the device for unfolding the shaped article 1 mentioned above is equipped with a first group of three vacuum-type absorbing means 3*a*, 3*b*, 3*c* and a second group of three vacuum-type absorbing means 3*d*, 3*e*, 3*f*. The first group of three vacuum-type absorbing means 3*a*, 3*b*, 3*c* is designed to absorb an outer surface of one of the side portions adjacent to the bent portion 1*g* of the shaped article 1 and the second group of three vacuum-type absorbing means 3*d*, 3*e*, 3*f* is designed to absorb an outer surface of the other of the side portions adjacent to the bent portion 1*g* of the shaped article 1.

Each vacuum-type absorbing means 3*a*, 3*b*, 3*c* in the first group has a length approximately corresponding to the length of the shaped article 1 and a width of approximately one third of the length of the width of a side portion of the shaped article 1 so that each absorbing means 3*a*, 3*b*, 3*c* can absorb corresponding area of the outer surface of the side portion and three of them can absorb almost the whole area of the outer surface of the side portion. The same thing can be said of the second group of three absorbing means 3*d*, 3*e*, 3*f*.

Since the structure of each absorbing means 3*a*, 3*b*, 3*c* is the same as the absorbing means of the first embodiment shown in FIG. 3, an explanation thereof is omitted.

Figure 11A:
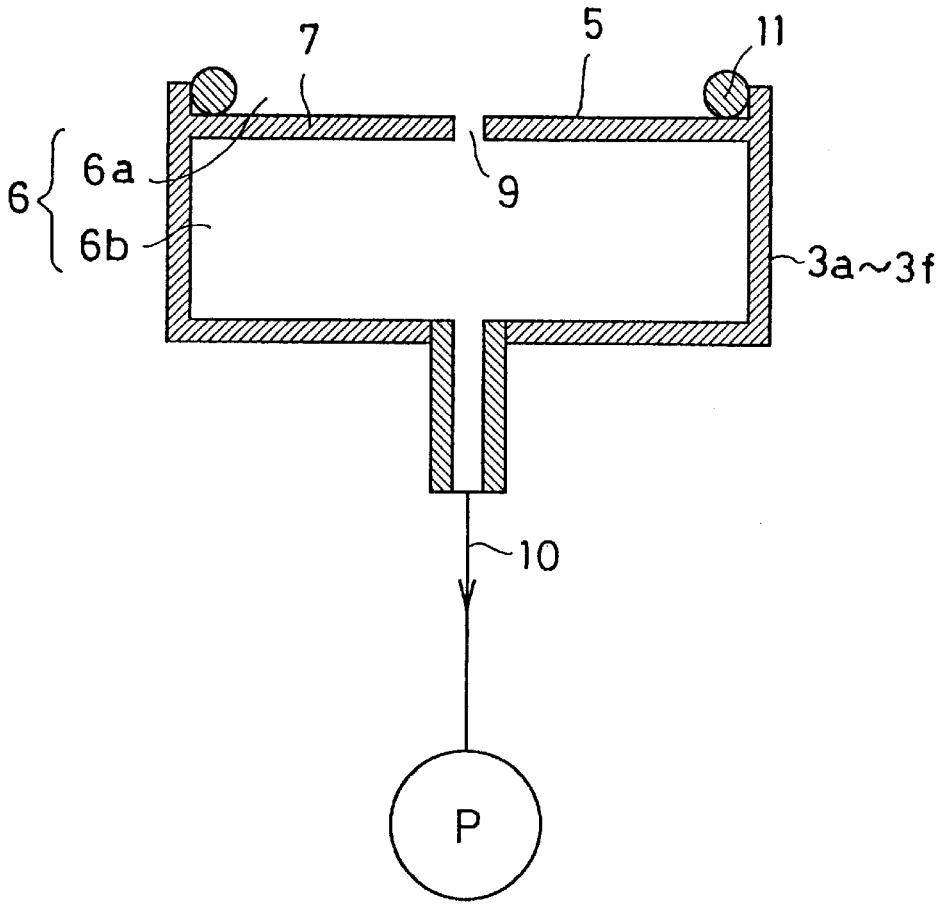
FIG. 11A is a cross-sectional view showing the inner structure of the absorbing means shown in FIG. 10.
Figure 11B:
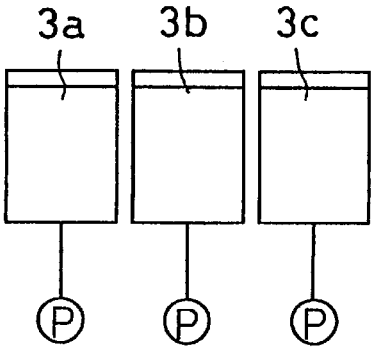
FIG. 11B shows an example of an absorbing circuit for a group of vacuum absorbing means.
Figure 11C:
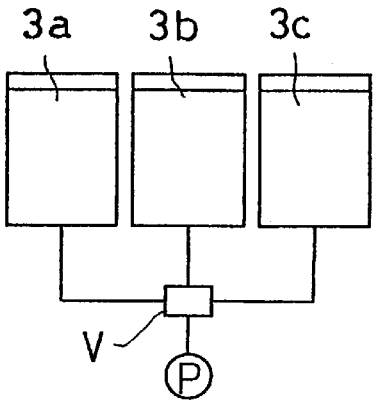
FIG. 11C shows another example of an absorbing circuit for a group of vacuum absorbing means.

As shown in FIG. 11B, a separate vacuum pump P may be connected to each vacuum-type absorbing means 3*a*, 3*b*, 3*c* of the first group, or, as shown in FIG. 11C, one vacuum pump P may be connected to each vacuum-type absorbing means 3*a*, 3*b*, 3*c* of the first group by way of a switching valve V. The same thing can be said if the second group of the absorbing means 3*d*, 3*e*, 3*f*.

As shown in FIGS. 10A and 10B, the first group of three vacuum-type absorbing means 3*a*, 3*b*, 3*c* is held so as to move together for unfolding operations and also the second group of three vacuum-type absorbing means 3*d*, 3*e*, 3*f* is held so as to move together for unfolding operations. The first group of three vacuum-type absorbing means 3*a*, 3*b*, 3*c* and the second group of three vacuum-type absorbing means 3*d*, 3*e*, 3*f* are relatively driven for unfolding operations by a driving mechanism (not shown). The relative working of the absorbing means can be performed by synchronously operated gear mechanism, or the like, each located at both ends of each absorbing means 3*a*, 3*b*, 3*c* and 3*d*, 3*e*, 3*f*.

The shaped article 1 will be unfolded as follows. As shown in FIG. 10A, in the event that the side portions 1*a*, 1*b* located at both sides of the bent portion 1*g* are unfolded about the bent portion 1*g*, the first group of three vacuum-type absorbing means 3*a*, 3*b*, 3*c* is placed on the outer surface of the first side portion 1*a* and the second group of three vacuum-type absorbing means 3*d*, 3*e*, 3*f* is placed on the outer surface of the second side portion 1*b*. Then, vacuum absorbing is performed to vacuum absorb the side portions 1*a*, 1*b*. Since on side portion 1*a* is divided into three areas and each area is vacuum absorbed by the vacuum-type absorbing means 3*a*, 3*b*, 3*c*, respectively, each absorbing area of each vacuum-type absorbing means 3*a*, 3*b*, 3*c* is approximately one third of the area of the side portion 1*a*, thereby enabling firm vacuum absorbing of the side portion 1*a* without absorbing ambient air even in the case that the flatness of the outer surface of the side portion 1*a* is low and/or the side portion 1*a* is twisted. Furthermore, because almost the whole area of the side portion 1*a* is absorbed by three vacuum-type absorbing means 3*a*, 3*b*, 3*c*, these three vacuum-type absorbing means 3*a*, 3*b*, 3*c* can firmly hold the side portion 1*a* with a strong vacuum absorbing force. As for the side portion 1*b*, the same thing can be said.

Thereafter, as shown in FIG. 10B, the first group of three vacuum-type absorbing means 3*a*, 3*b*, 3*c* is relatively moved against the second group of three vacuum-type absorbing means 3*d*, 3*e*, 3*f* such that the side portions 1*a*, 1*b* are unfolded about the bent portion 1*g* and become flat. Because both groups of the vacuum-type absorbing means 3*a*, 3*b*, 3*c*, 3*d*, 3*e*, 3*f* firmly absorb the side portions 1*a*, 1*b*, proper unfolding operations can be performed.

By unfolding the remaining bent portions 1*h*, 1*i*, 1*j*, 1*k* one after the other in the same manner as mentioned above, a wide flat article is obtained.

Figure 13A:
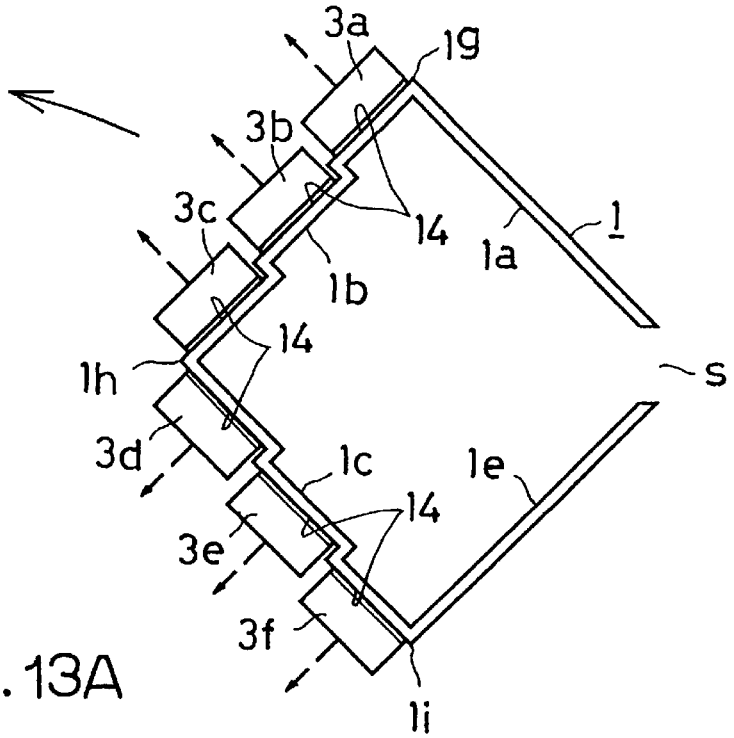
Figure 13B:
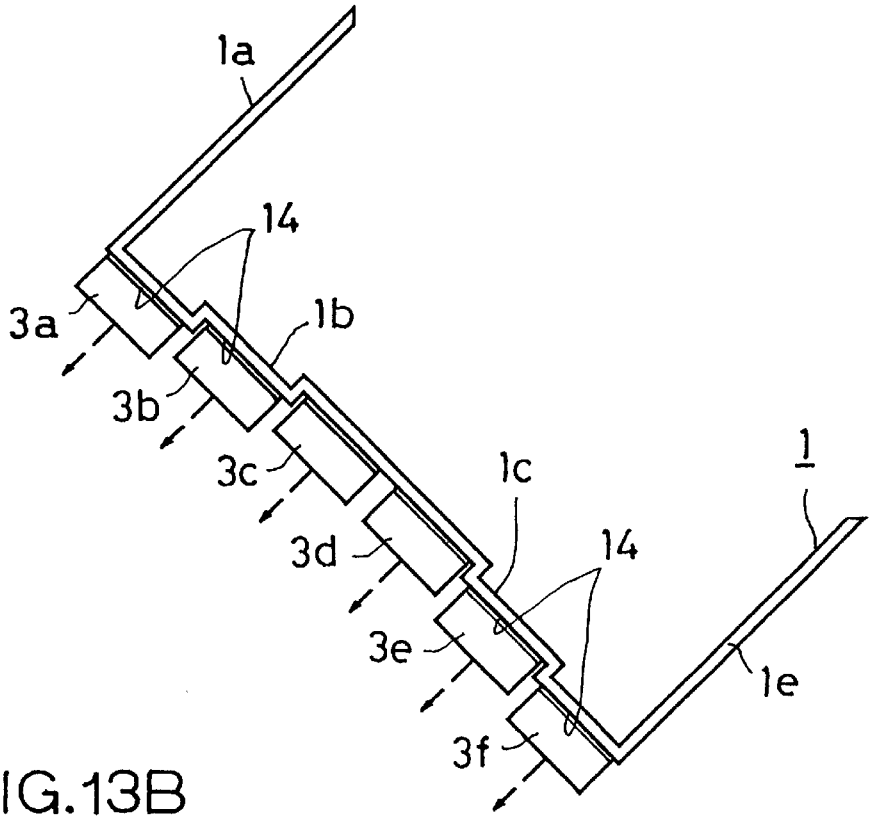

FIGS. 13A and 13B show another variation of the latter embodiment. In this embodiment, a shaped article to be unfolded is a cylindrical extruded article having a rectangular cross-section. The shaped article 1 has both side portions 1*b*, 1*c* each having a stepped outer surface 14 and a bent portion 1*h* located between the side portions 1*b*, 1*c*. In the case of the above-mentioned shaped article, as shown in FIG. 13A, the stepped outer surfaces 14 of one side portion 1*b* are vacuum absorbed by the first group of a plurality of vacuum-type absorbing means 3*a*, 3*b*, 3*c* and the stepped outer surfaces 14 of the other side portion 1*c* are vacuum absorbed by the second group of a plurality of vacuum-type absorbing means 3*d*, 3*e*, 3*f*. Then, as shown in FIG. 13B, by relatively moving the first group of the vacuum-type absorbing means 3*a*, 3*b*, 3*c* and the second group of the vacuum-type absorbing means 3*d*, 3*e*, 3*f*, both side portions 1*b*, 1*c* an be unfolded about the bent portion 1*h*. As will be apparent from the above, the above mentioned vacuum-type absorbing means can be applied to various kinds of shaped articles.

Though the third embodiment according to the present invention is described above, the present invention is not limited to the above. In the above mentioned embodiment, three divided areas of the side portion of the shaped article are absorbed by three absorbing means, respectively, however, the number of areas to be divided is not limited to three. The outer surface of the side portion of the shaped article may be divided into a plurality of areas along the length thereof and each area may be separately absorbed by a vacuum-type absorbing means, or the outer surface of the side portion of the shaped article may be divided into a plurality of areas along the length and width thereof and each area may be separately absorbed by a vacuum-type absorbing means. In the above mentioned embodiment, a group of a plurality of vacuum-type absorbing means absorbs an outer surface of the side portion of the shaped article, but one vacuum-type absorbing means having a plurality of vacuum-type absorbing portions may absorb an outer surface of the side portion of the shaped article. Furthermore, in the above mentioned embodiment, each bent portion is unfolded one after the other by the first and second vacuum-type absorbing means, both the shaped article may be unfolded in one operation by a plurality of groups of vacuum-type absorbing means corresponding to the side portion of the shaped article. Or, one side portion may be absorbed by one group of vacuum-type absorbing means, and the other side portion may be held by means other than vacuum-type absorbing means.

As mentioned above, in the method for unfolding a shaped article according to the third embodiment, because an outer surface of a side portion is divided into a plurality of areas and separate vacuum-type absorbing means absorbs each area, each absorbing area becomes small, thereby enabling firm vacuum absorbing of an outer surface of the side portion by restraining or restricting absorbing ambient air even if flatness of an outer surface of a side portion is low and/or the side portion is twisted. Further, because an outer surface of one side portion is divided into a plurality of areas and each area is to be absorbed, the side portion is vacuum absorbed with a large absorbing area, thereby enabling the absorbing means to hold the outer surface of the side portion with strong absorbing force. Therefore, even in the case that flatness of an outer surface of a side portion of a shaped article is low and/or the shaped article is twisted, procedures for flattening or correcting the shaped article before unfolding procedures can be omitted and proper unfolding procedures can be performed without causing any trouble.

The above description has been made in connection with specific embodiments, and the invention is not limited to such embodiments. As would be apparent to those skilled in the art, various substitutions and modifications within the scope and spirit of the invention are contemplated.

What is claimed is:

1. A device for unfolding a shaped metal article having a longitudinal bent portion such that the shaped metal article is unfolded along the bent portion, comprising:

a vacuum-type absorbing means for absorbing at least one side of the shaped metal article adjacent to the bent portion; and a driving mechanism for moving said absorbing means so as to unfold the one side against the other side of the shaped metal article about the bent portion.

2. The device for unfolding a shaped metal article as recited in claim 1, wherein both sides of the shaped metal article are absorbed by said vacuum-type absorbing means and said vacuum-type absorbing means are relatively moved by said driving mechanism so as to unfold both sides of the shaped metal article about the bent portion.

3. The device for unfolding a shaped metal article as recited in claim 1 or 2, wherein the vacuum-type absorbing means has a vacuum chamber opened toward an absorbing portion, the vacuum chamber being divided by an inner partition into an outside chamber and an inside chamber, both of the chambers communicating with each other by way of a communication port formed in the partition, and wherein the inner chamber is connected to a vacuum device.

4. The device for unfolding a shaped metal article as recited in claim 3, wherein the outside chamber has a shallow bottom and the inside chamber has a large volume.

5. The device for unfolding a shaped metal article as recited in claim 4, further comprising a packing ring disposed around the inner peripheral portion of the outside chamber.

6. A method for unfolding a shaped metal article having a longitudinal bent portion such that the shaped metal article is unfolded along the bent portion, including the steps of:

absorbing at least one side of the shaped metal article adjacent to the bent portion by a vacuum-type absorbing means; and driving said absorbing means so as to unfold the one side against the other side of the shaped metal article about the bent portion by a driving mechanism.

7. The method for unfolding a shaped metal article as recited in claim 6, wherein both sides of the shaped metal article is absorbed by the vacuum-type absorbing means and then the vacuum-type absorbing means is relatively driven so as to unfold both sides of the shaped metal article about the bent portion.

8. The method for unfolding a shaped metal article as recited in claim 6 or 7, wherein the shaped metal article is a polygonal hollow aluminum extruded article having N flat portions connected by the N-1 of bent portions, and the first and Nth of flat portions are adjacent and separated by a slit.

9. The method for unfolding a shaped metal article as recited in claim 8, wherein the metal shaped article is formed by extruding an aluminum hollow article having an imitation portion formed on one of N vertexes and then removing the imitation portion.

10. The method for unfolding a shaped metal article as recited in claim 6 or 7, wherein the vacuum-type absorbing means has a vacuum chamber opened toward an absorbing portion, the vacuum chamber being divided by an inner partition into an outside chamber and an inside chamber, both of the chambers communicating with each other by way of a communication port formed in the partition, and wherein the inner chamber is connected to a vacuum device, the absorbing portion of the vacuum-type absorbing means is placed on a surface of the shaped article and performs the vacuum absorbing operation.

11. The method for unfolding a shaped metal article as recited in claim 10, wherein the outside chamber has a shallow bottom and the inside chamber has a large volume.

12. The method for unfolding a shaped metal article as recited in claim 11, further comprising a packing ring disposed around the inner peripheral portion of the outside chamber so as to seal the vacuum-type absorbing means and the shaped article.

13. A method for unfolding a shaped metal article having a bent portion and a pair of side portions adjacent to the bent portion, at least one of the side portions having a dented portion, such that one of the side portion having the dented portion is absorbed by a vacuum-type absorbing means to unfold about the bent portion, including the steps of:

fitting a seal member in the dented portion so as to seal a space formed between the vacuum-type absorbing means and the side portion;

placing the vacuum-type absorbing means on the side portion with the absorbing means crossing over the dented portion; and driving the absorbing means to unfold the article.

14. The method for unfolding a shaped metal article as recited in claim 13, wherein the seal member is made of elastic materials.

15. The method for unfolding a shaped metal article having a bent portion such that a side portion adjacent to the bent portion is absorbed by a vacuum-type absorbing means which moves and unfolds the article about the bent portion, said method including the steps of:

dividing an outer surface area of the side portion;

absorbing each area separately; and unfolding the article.

* * * * *